US008152084B2

(12) United States Patent
Lee et al.

(10) Patent No.: US 8,152,084 B2
(45) Date of Patent: Apr. 10, 2012

(54) DRIER FOR FOOD WASTE DISPOSAL SYSTEM

(75) Inventors: Kwang Jae Lee, Gyeonggi-do (KR); Sung Jin Kim, Seoul (KR)

(73) Assignee: Woongjin Coway Co., Ltd., Chungcheongnam-Do (KR)

( * ) Notice: Subject to any disclaimer, the term of this patent is extended or adjusted under 35 U.S.C. 154(b) by 0 days.

(21) Appl. No.: 12/978,033

(22) Filed: Dec. 23, 2010

(65) Prior Publication Data

US 2011/0089275 A1 Apr. 21, 2011

Related U.S. Application Data

(62) Division of application No. 12/317,592, filed on Dec. 23, 2008, now Pat. No. 7,883,040.

(30) Foreign Application Priority Data

Dec. 31, 2007 (KR) ..... 10-2007-0141315
Dec. 31, 2007 (KR) ..... 10-2007-0141316
Dec. 31, 2007 (KR) ..... 10-2007-0141317

(51) Int. Cl.
*B02C 19/00* (2006.01)

(52) U.S. Cl. ..... 241/65; 241/101.2

(58) Field of Classification Search ..... 241/65, 241/101.2, 260.1
See application file for complete search history.

(56) References Cited

U.S. PATENT DOCUMENTS

| | | | | |
|---|---|---|---|---|
| 4,256,035 | A * | 3/1981 | Neufeldt | 100/145 |
| 5,123,600 | A | 6/1992 | Takenaka | |
| 5,395,055 | A * | 3/1995 | Shutov et al. | 241/16 |
| 5,526,991 | A * | 6/1996 | Bacher et al. | 241/65 |
| 5,704,555 | A * | 1/1998 | Arastoopour | 241/16 |
| 5,779,165 | A | 7/1998 | Kim | |
| 6,325,307 | B1 | 12/2001 | Nikolskii et al. | |
| 6,588,690 | B1 | 7/2003 | Koenig | |
| 6,702,211 | B2 | 3/2004 | Yamamoto | |
| 7,883,040 | B2 * | 2/2011 | Lee et al. | 241/65 |
| 2002/0125352 | A1 | 9/2002 | Ivanov et al. | |

FOREIGN PATENT DOCUMENTS

| | | | |
|---|---|---|---|
| WO | 2004/047995 | A1 | 6/2004 |
| WO | 2005/061134 | A1 | 7/2005 |

* cited by examiner

*Primary Examiner* — Faye Francis
(74) *Attorney, Agent, or Firm* — Peter F. Corless; Christine C. O'Day; Edmonds Wildman Palmer LLP

(57) ABSTRACT

A drier for a food waste disposal system. A hollow drum has a charge port and a discharge port for food waste. An agitating screw has a rotating thread which is rotatably disposed in an inner space of the drum and agitates and crushes the food waste, and a rotating shaft around which the rotating thread is disposed. A motor is installed on a first end of the drum, and provides a rotating force to the agitating screw. A crusher has a crush plate installed on a second end of the drum and a plurality of inclined crushing blades arranged radially, and a crush plate support installed around an upper portion of the crush plate. A heater is installed on an outer surface of the drum, and when powered provides high-temperature heat for the inner space of the drum, drying the food waste.

7 Claims, 8 Drawing Sheets

DRIER FOR FOOD WASTE DISPOSAL SYSTEM

BACKGROUND OF THE INVENTION

1. Field of the Invention

The present invention relates, in general, to a drier for a food waste disposal system which improves crushing performance, and more particularly, to a drier for a food waste disposal system which has a radially crushing structure such that food waste can be prevented from sticking adjacent to a crusher when an agitating screw is operated, which facilitates transference of the food waste, which is equipped with an agitating screw having at least one rotating thread such that overload is not applied to a motor when rotated, and which improves crushing performance by virtue of the easy transference and crushing of the food waste.

2. Description of the Related Art

In general, food waste is processed by fermentation, incineration, recycling into animal feed and fertilizer (compost), burial in the ground, and so on. These methods not only require large-scale facilities but also give rise to various side effects such as offensive odors and inconvenient collection, transportation and storage as well as the serious social problem of environmental pollution.

Thus, there is an urgent demand for a method to reduce environmental pollution attributable to food waste and recycling of the food waste.

Meanwhile, although the total number of households in Korea has reached ten million at present, countermeasures for food waste disposal methods associated with environmental pollution and their effects are still unsatisfactory. This is mainly attributable to housewives who have an insufficient grasp of the wasting of resources and environmental pollution.

Accordingly, in order not only to inhibit generation of food waste but also to efficiently recycle it, it is essentially necessary to develop a household food processing system capable of coping with such problems.

Generally, a food waste disposal apparatus which is connected to a kitchen sink of the household is configured to remove moisture from the food waste via a series of processes such as dehydration, cutting and drying, to thus reduce a volume of the food waste, thereby sharply reducing the quantity of discharged food waste.

This food waste disposal apparatus, as attached to the kitchen sink or freestanding, includes a charge port into which the food waste is charged, a dehydrating and cutting unit for dehydrating the food waste by compression and cutting the food waste into pieces, a transfer unit for transferring in one direction the dehydrated and cut food waste, a drier for uniformly mixing and distributing the food waste dehydrated and cut by means of a rotating screw turned in one direction by a motor and for removing moisture from the food waste by means of high-temperature heat to thereby dry the food waste, and a discharge box into which the dried food waste is discharged and stored.

Meanwhile, the food waste, from which the drier has completely removed residual moisture using the high-temperature heat, is all discharged through a discharge port passing through a floor of the drier. Then, new food waste dehydrated and cut by the dehydrating and cutting unit is charged again into the drier from which all the food waste was previously discharged, and is dried.

However, in the case in which a large quantity of starch or moisture is contained in the food waste charged into the drier, the food waste agitated and crushed by the rotating screw has high viscosity, so that it has a high possibility of becoming attached to an inner wall or corners of the drier or the rotating screw.

In this case, a heat transfer coefficient of the heat transmitted from the inner wall to the interior of the drier is degraded by the food waste which is excessively attached to the inner wall of the drier. For this reason, the efficiency of drying the food waste is reduced, so that the crushing efficiency of the food waste in the drier is also reduced, thereby rendering it difficult to transfer the food waste.

In particular, the food waste frequently becomes attached around a crushing region of the drier due to the pressure caused by the rotation of the rotating screw. In this case, the motor can be overloaded causing damage, and the rotating screw can be damaged by the attached food waste.

Further, the food waste can be pushed by the rotating screw, and be discharged to the outside through the charge port. In the case in which the food waste is attached to the inner wall of the drier, the motor is overloaded when the rotating screw is rotated.

SUMMARY OF THE INVENTION

Accordingly, the present invention has been made keeping in mind the above problems occurring in the related art, and embodiments of the present invention provide a drier for a food waste disposal system, which has a radial crushing structure such that food waste can be prevented from becoming stuck adjacent to a crusher when an agitating screw is operated, which facilitates transferring the food waste, which is equipped with the agitating screw having at least one rotating thread such that overload is not applied to a motor when it is rotated, and which improves crushing performance by easily crushing and transferring the food waste.

According to one aspect of the present invention, there is provided a drier for a food waste disposal system. The drier includes: a hollow drum having a charge port into which dehydrated food waste is charged and a discharge port through which dried food waste is discharged; an agitating screw having a rotating thread which is rotatably disposed in an inner space of the drum and agitates and crushes the dehydrated food waste charged into the drum, and a rotating shaft around which the rotating thread is helically disposed; a motor installed on a first end of the drum and providing a rotating force to the agitating screw; a crusher having a circular crush plate that is installed on a second end of in an inner space of the drum in which the motor is coupled with the agitating screw and which has a plurality of inclined crushing blades arranged radially, and an arcuate crush plate support which is installed around an upper portion of the crush plate; and a heater installed on an outer surface of the drum which when powered provides high-temperature heat for the inner space of the drum thereby drying the food waste.

In an embodiment of the present invention, the drum may include a plurality of ridges on an inner surface thereof which extends in an axial direction.

In another embodiment of the present invention, the drum may include a plurality of knobs on an inner surface thereof which protrudes at a predetermined height in an inward radial direction.

In another embodiment of the present invention, the ridges may be symmetrically disposed on left and right sides centering on a bottom of the drum.

In another embodiment of the present invention, the crush plate support may include a circular plate member surrounding the crush plate, and rib members protruding from an outer surface of the plate member in a radial direction.

According to another aspect of the present invention, there is provided a drier for a food waste disposal system. The drier includes: a hollow drum having a charge port into which dehydrated food waste is charged and a discharge port through which dried food waste is discharged; an agitating screw having at least one hook-shaped rotating thread which is rotatably disposed in an inner space of the drum and which agitates and crushes the dehydrated food waste charged into the drum, and a rotating shaft around which the rotating thread is disposed; a motor installed on a first end of the drum and providing a rotating force to the agitating screw; and a heater installed on an outer surface of the drum which when powered provides high-temperature heat for the inner space of the drum thereby drying the food waste In an embodiment of the present invention, the rotating threads may be spaced apart from each other, and include crooked ends so as to face each other.

In another embodiment of the present invention, the rotating threads may be removably mounted on the rotating shaft.

In another embodiment of the present invention, the drier may further includes a crusher having a circular crush plate that is installed on a second end of in an inner space of the drum in which the motor is coupled with the agitating screw and that has a plurality of inclined crushing blades in a radial direction, and an arcuate crush plate support which is installed around an upper portion of the crush plate.

In another embodiment of the present invention, the crush plate support may include a circular plate member surrounding the crush plate, and rib members protruding from an outer surface of the plate member in a radial direction.

In another embodiment of the present invention, the drum may include a plurality of ridges on an inner surface thereof which extends in an axial direction.

In another embodiment of the present invention, the drum may include a plurality of knobs on an inner surface thereof which protrudes at a predetermined height in an inward radial direction.

In another embodiment of the present invention, the ridges may be symmetrically disposed on left and right sides centering on a bottom of the drum.

According to embodiments of the present invention, the drier for a food waste disposal system prevents the food waste from becoming stuck adjacent to the crusher when the agitating screw is operated, and avoids accumulation of the food waste when the rotating thread of the agitating screw is rotated, so that it can prevent overload of the motor and damage to the agitating screw, etc. installed in the drier. Further, the drier prevents the food waste from easily sticking itself to the inner surface of the drum or the agitating screw, causes the stuck food waste to be separated from the inner surface of the drum or the agitating screw when the agitating screw is operated, so that transferring and crushing of the food waste can be facilitated.

BRIEF DESCRIPTION OF THE DRAWINGS

The above and other objects, features and advantages of the present invention will be more clearly understood from the following detailed description when taken in conjunction with the accompanying drawings, in which.

DETAILED DESCRIPTION OF THE INVENTION

Reference will now be made in greater detail to exemplary embodiments of the invention with reference to the accompanying drawings.

Figure 1:
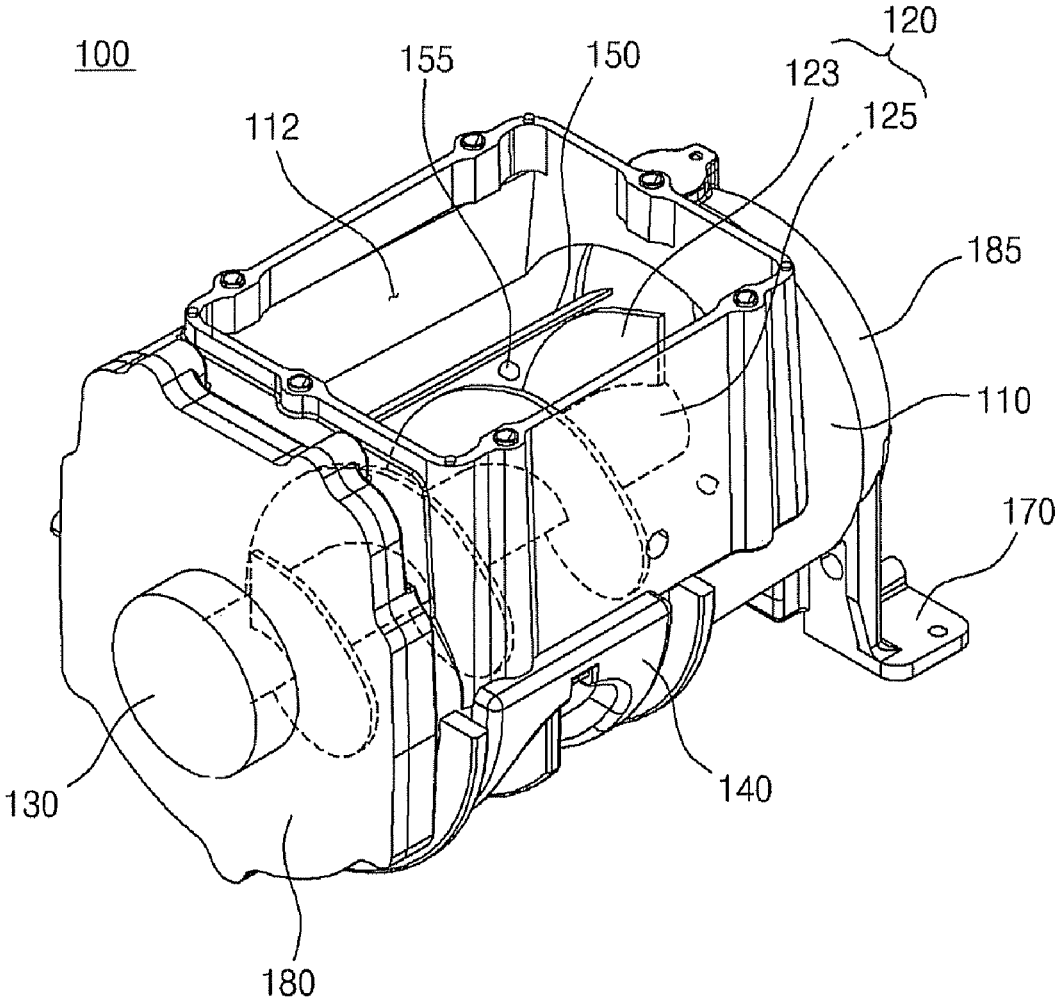
FIG. 1 is a right-side perspective view illustrating a drier for a food waste disposal system according to an embodiment of the present invention.
Figure 2:
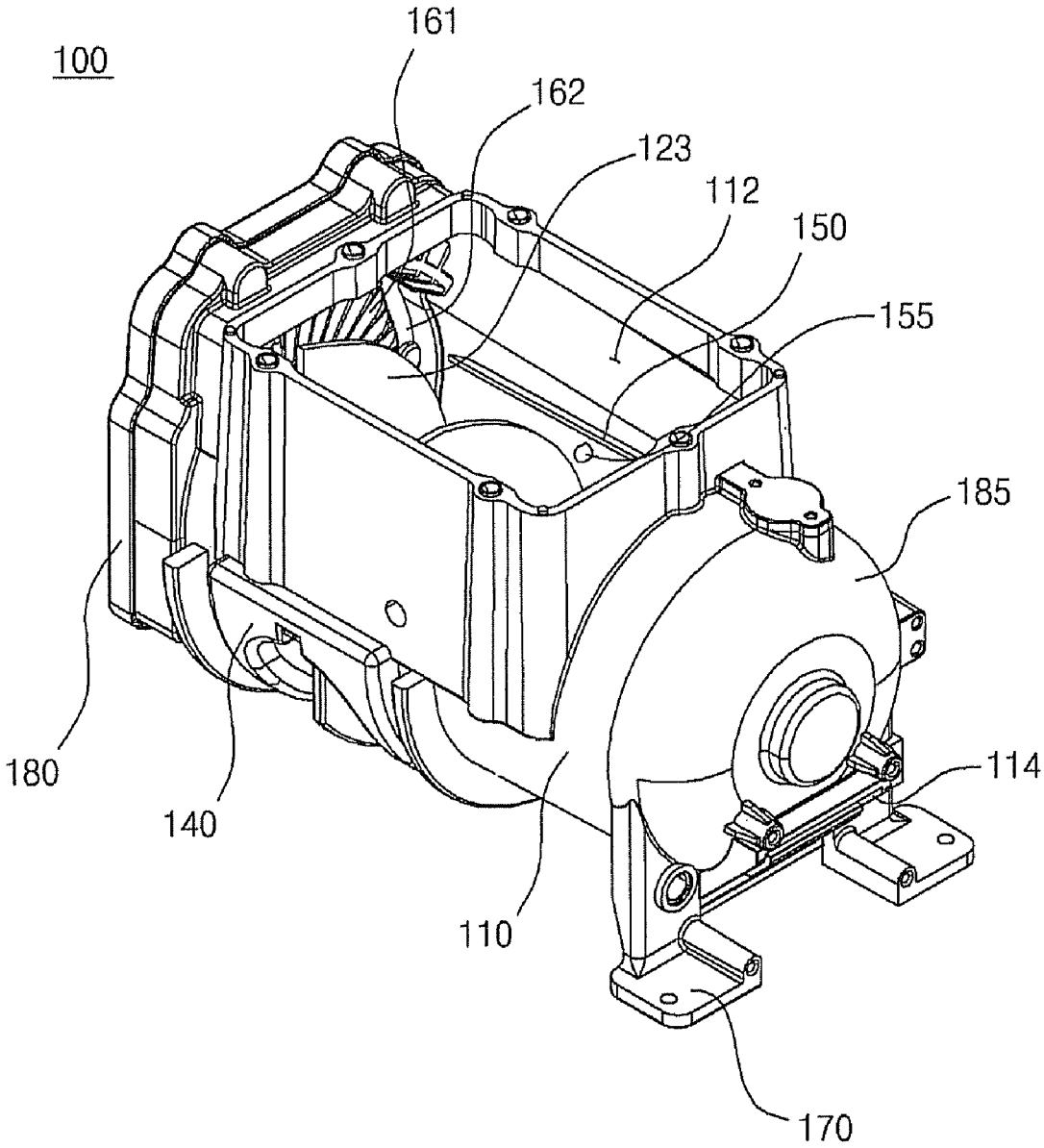
FIG. 2 is a left-side perspective view illustrating a drier for a food waste disposal system according to an embodiment of the present invention.
Figure 3:
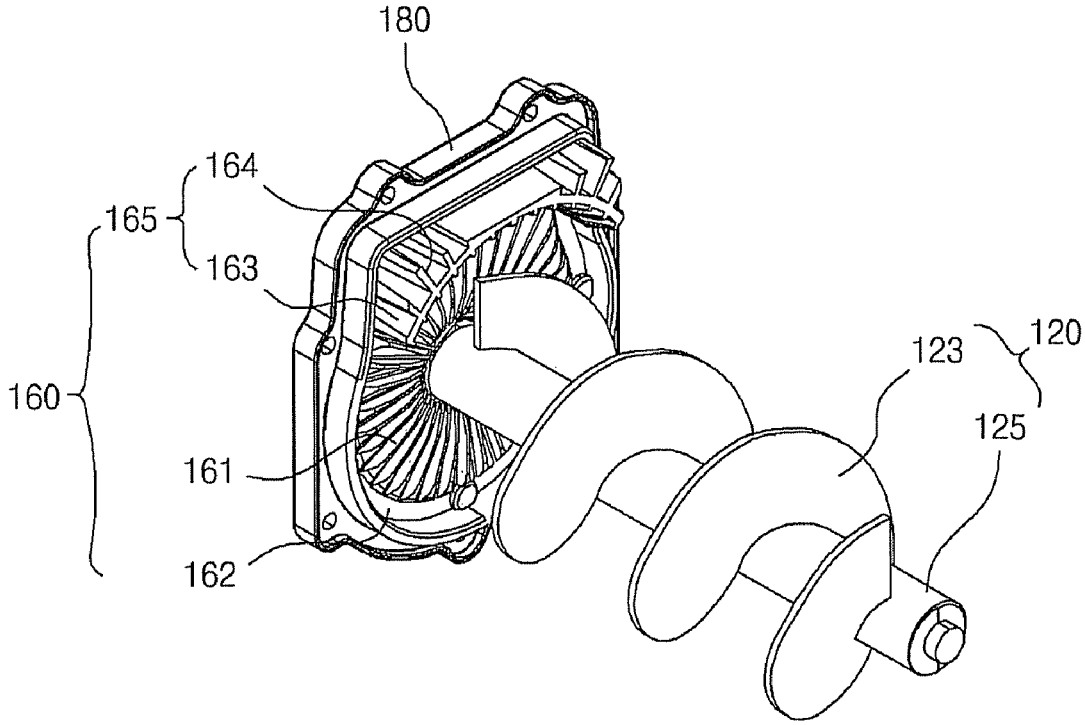
FIG. 3 is a perspective view illustrating an assembly of an agitating screw and a crusher installed in the drier for a food waste disposal system illustrated in FIG. 1.
Figure 4:
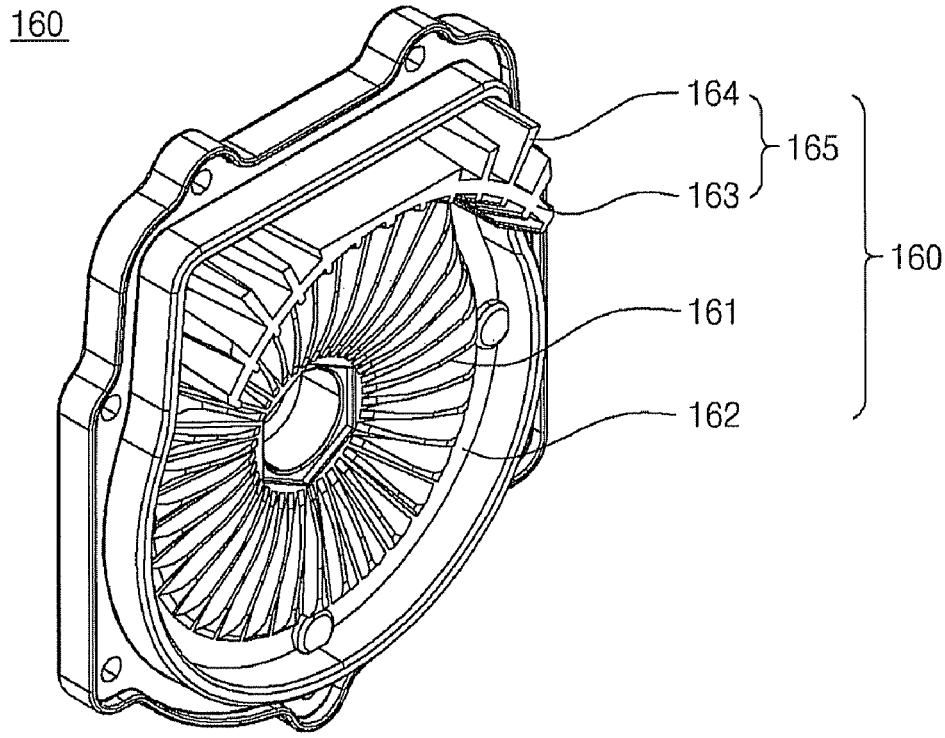
FIG. 4 is a perspective view illustrating a crusher installed in the drier for a food waste disposal system illustrated in FIG. 3.

FIG. 1 is a right-side perspective view illustrating a drier for a food waste disposal system according to an embodiment of the present invention. FIG. 2 is a left-side perspective view illustrating a drier for a food waste disposal system according to an embodiment of the present invention. FIG. 3 is a perspective view illustrating an assembly of an agitating screw and a crusher installed in the drier for the food waste disposal system illustrated in FIG. 1. FIG. 4 is a perspective view illustrating a crusher installed in the drier for the food waste disposal system illustrated in FIG. 3.

Figure 5:
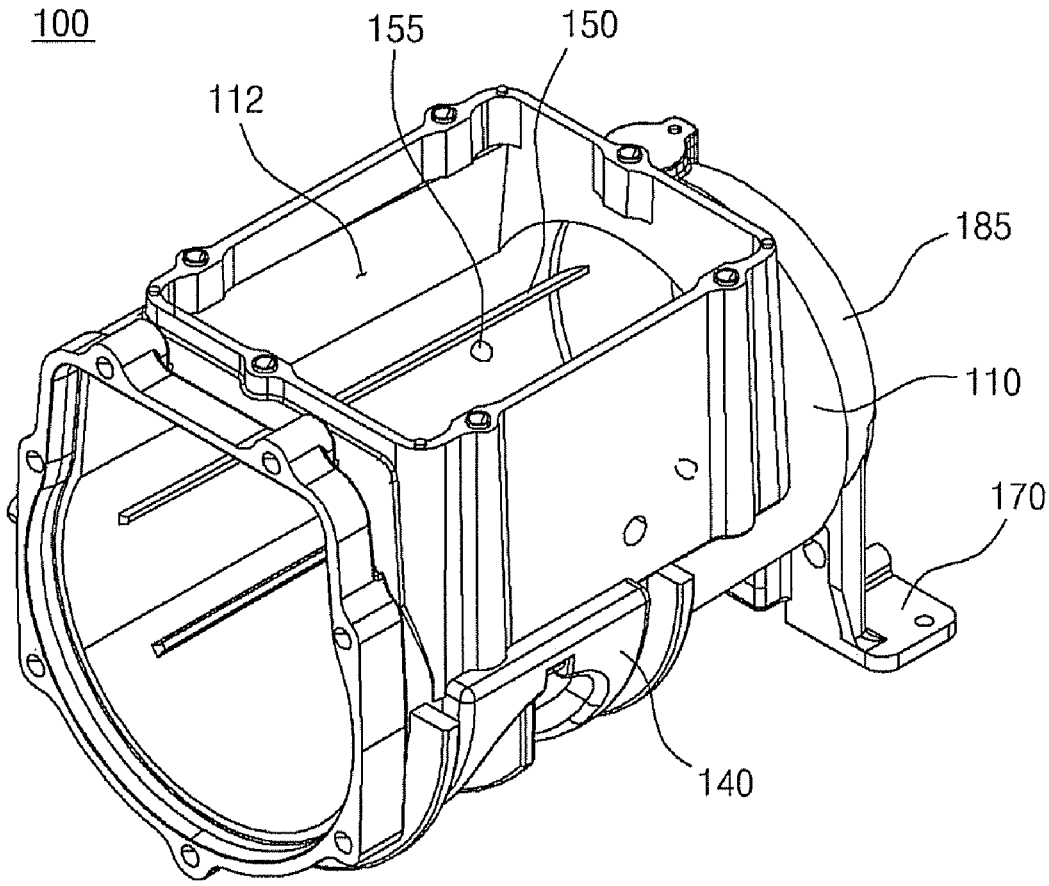
FIG. 5 is a perspective view illustrating the state in which an agitating screw and a crusher are removed from the drier for a food waste disposal system illustrated in FIG. 1.
Figure 6:
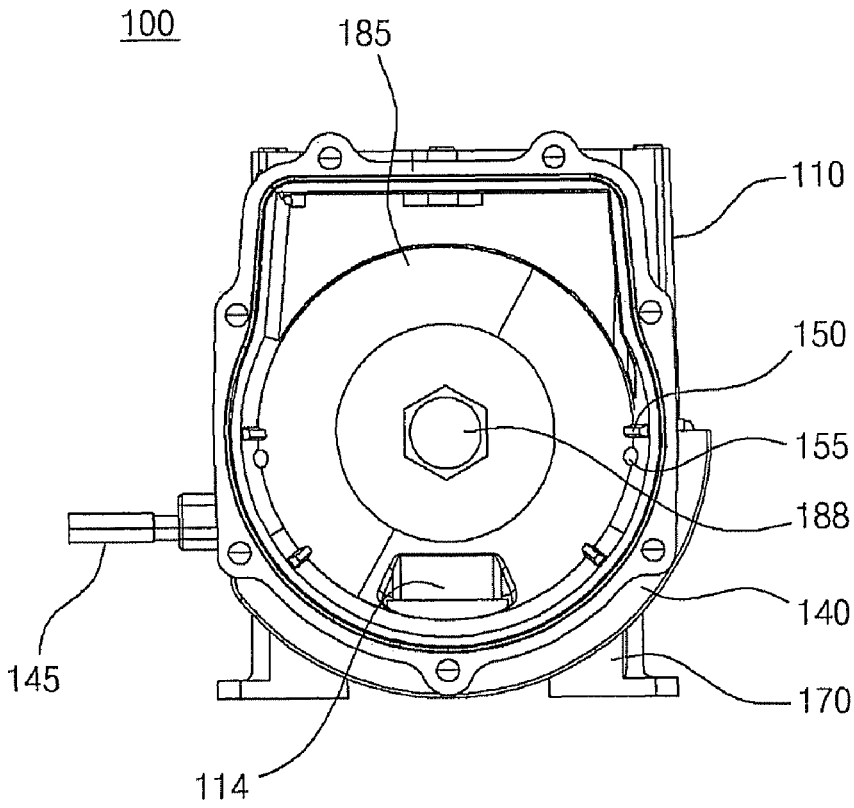
FIG. 6 is a side view illustrating the drier for a food waste disposal system illustrated in FIG. 5.
Figure 7:
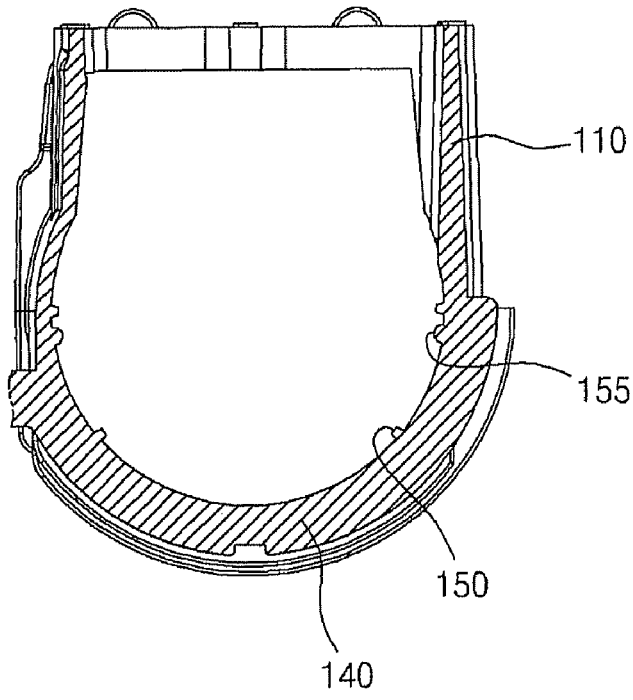
FIG. 7 is a side sectional view illustrating the drier for a food waste disposal system illustrated in FIG. 6.

FIG. 5 is a perspective view illustrating the state in which an agitating screw and a crusher are removed from the drier for the food waste disposal system illustrated in FIG. 1. FIG. 6 is a side view illustrating the drier for the food waste disposal system illustrated in FIG. 5. FIG. 7 is a side sectional view illustrating the drier for the food waste disposal system illustrated in FIG. 6.

Referring to FIGS. 1 through 7, the drier for a food waste disposal system according to an embodiment of the present invention includes: a hollow drum 110 having a charge port 112 into which dehydrated food waste is charged and a discharge port 114 through which dried food waste is discharged; an agitating screw 120 having a rotating thread 123 which is rotatably disposed in an inner or drying space of the drum 110 and agitates and crushes the dehydrated food waste charged into the drum 110, and a rotating shaft 125 around which the rotating thread 123 is helically disposed; a motor 130 installed on a first end of the drum 110 and providing a rotating force to the agitating screw 120; a crusher 160 having a circular crush plate 162 that is installed on the second end of the drum 110 in which the motor 130 is coupled with the agitating screw 120 and that has a plurality of inclined crushing blades 161 arranged radially, and an arcuate crush plate support 165 which is installed around an upper portion of the crush plate 162; and a heater 140 installed on an outer surface of the drum 110 and which when powered provides high-temperature heat for the inner space of the drum 110 to thereby dry the food waste.

The drier 100 for a food waste disposal system leaves a part of the completely dried food waste on a floor of the drying space, and then mixes the remaining food waste with the subsequently charged new food waste, so that it can lower the viscosity of the entirety of the food waste in the drying space.

The drum 110 has a charge port 112 formed in an upper surface thereof and a discharge port 114 formed at a lower portion of the second end thereof, and has the shape of a roughly hollow cylinder having a predetermined volume of inner space such that the food waste can be charged in a predetermined amount. Of course, the drum 110 may have a shape other than the cylindrical shape.

The charge port 112 of the drum 110 is formed as an opening having a predetermined size in the upper surface of the drum 110 disposed in a horizontal direction so as to be able to charge the food waste which has been dehydrated and cut past a hopper connected with a kitchen sink (not shown).

The discharge port 114 is located at the lower portion of the second end of the drum 110 so as to discharge the food waste, from which moisture has been removed by high-temperature heat, from the inner space of the drum 110 in the completely dried state.

The drum 110 is preferably manufactured by casting using metal having a high heat transfer coefficient. Such a metal for the drum 110 includes stainless steel or aluminum.

The agitating screw 120 is disposed in the inner space of the drum 110 so as to be rotatable in a forward or backward direction such that the food waste charged into the inner space through the charge port 112 of the drum 110 can be agitated and crushed.

The agitating screw 120 is a rotary member in which at least one rotating thread 123 is mounted on a rod-like rotating shaft 125. One end of the rotating shaft 125 is coupled with the motor 130 installed on a front cap 180 at the first end of the drum 110, and the other end of the rotating shaft 125 is installed and supported in the shaft hole (not shown) of a rear cap 185 at the second end of the drum 110.

In this case, the inner surface of the drum 110 is spaced apart from the rotating thread 123 of the agitating screw 120 by a gap having a predetermined interval such that the rotating thread 123 rotates without interference.

Of course, this gap should be greater than the minimum gap that stops the food waste from becoming jammed.

The motor 130 functions as a driving source that rotates the agitating screw 120 disposed in the inner space of the drum 110 in a forward or backward direction.

The rear cap 185 is provided with a support bracket 170 thereunder which encloses a lower portion of the rear cap 185 so as to support the entire drier 100. In order to couple the drier 100 to the interior of the body of the food waste disposal system, the support bracket 170 is provided with holes having a predetermined size, through each of which a fastening member is fastened. The fastening member includes a bolt or a screw.

The agitating screw 120 is coupled at the other end thereof with the crusher 160 which crushes the food waste transferred by the agitating screw 120. When the agitating screw 120 is rotated in a backward direction, the food waste is transferred toward the crusher 160. In contrast, when the agitating screw 120 is rotated in a forward direction, the food waste is transferred toward the discharge port 114.

The heater 140 is installed on the outer surface of the drum 110, and provides high-temperature heat for the inner space, i.e. the drying space, of the drum 110 when powered, thereby removing the moisture from the food waste charged into the inner space until the food waste is completely dried.

This heater 140 includes a heating plate, which has an excellent heat transfer coefficient and is attached to the outer surface of the drum 110, and is electrically connected with a power supply (not shown) for supplying electric energy. The heater 140 includes a sheath heater.

The drier for a food waste disposal system further includes beneath the drier a discharge box (not shown) which collects the food waste discharged through the discharge port 114.

The food waste is charged into the inner space through the charge port 112 of the drum 110, and then is dried until the moisture thereof is completely removed by the high-temperature heat provided by the heater 140. Then, the food waste is agitated and crushed by the agitating screw 120, and is transferred toward the discharge port 114.

Most of the food waste is discharged to the discharge box (not shown) through the discharge port 114, but the part of the food waste which is not dried or which is dried and is attached to the inner surface of the drum 110, is left behind on the inner surface of the drum 110.

In order to cope with this residual, the drum 110 is provided with a plurality of ridges 150 or a plurality of knobs 155 on the inner surface thereof, wherein the ridges 150 extend in an axial direction, and the knobs 155 protrude at a predetermined height in a radial inward direction (see FIGS. 5 through 7).

The food waste attached around the agitating screw 120 or to the inner surface of the drum 110 is not easily dislodged while the agitating screw 120 is rotating. If the food waste is caught on the ridges 150 and knobs 155 formed on the inner surface of the drum 110, the food waste easily separates due to frictional force.

Furthermore, this configuration can improve the agitating efficiency of mixing or distributing the food waste and the crushing efficiency of crushing the food waste using the agitating screw 120, can facilitate transferring the food waste, prevent the motor 130 rotating the agitating screw 120 from being overloaded, and stably rotate the agitating screw 120 without damaging the motor 130.

Each ridge 150 can be formed on the inner surface of the drum 110 in a circumferential or inclined direction, and have a semicircular or polygonal cross section. However, in order to prevent each ridge 150 from being damaged by friction with the food waste when the agitating screw 120 is rotated, each ridge 150 is preferably formed so as to have a semicircular cross section.

Each knob 155 has a predetermined height so as not to come into contact with the rotating agitating screw 120. Each knob 155 has a semispherical shape. Of course, each knob 155 may have an oval or polygonal shape.

The ridges 150 can be disposed in two pairs on the left and right sides centering on the bottom of the cylindrical drum 110. However, the ridges 150 may be disposed in three or more pairs.

Since the food waste is dislodged from the inner surface of the drum 110 or the agitating screw 120 by the friction generated with the ridges 150 or the knobs 155, the heat supplied from the heater 140 is smoothly transmitted to the inner space of the drum 110 without loss, and so the heat transfer efficiency is improved upon. As a result, the efficiency of drying can be increased.

Particularly, when the agitating screw 120 is rotated in an opposite direction, the food waste is crushed by the crusher 160. In this case, part of the food waste may be stuck to the surroundings of the crusher 160. At this time, the motor 130 rotating the agitating screw 120 may be overloaded. In order to solve this problem, the crusher 160 is subjected to structural deformation according to an embodiment of the present invention.

More specifically, referring to FIGS. 3 and 4, the crusher 160 includes a crush plate 162 directly crushing the food waste, and a crush plate support 165 supporting the crush plate 162.

The circular crush plate 162 is installed on the second end of the drum 110 in which the motor 130 is coupled with the agitating screw 120, and has a plurality of inclined crushing blades 161 arranged radially. The arcuate crush plate support 165 is installed around an upper portion of the crush plate 162.

The food waste transferred by the agitating screw 120 can be crushed in a radial direction by the circular crush plate 162.

Since the crush plate support 165 is formed in an arcuate shape, it can be found that the crush plate support 165 does not come into contact with an outer edge of the rotating thread 123 of the agitating screw 120 when the agitating screw 120 rotates.

The crush plate support 165 includes a circular plate member 163 surrounding the crush plate 162, and rib members 164 protruding from an outer surface of the plate member 163 in a radial direction.

Because the rib members 164 support the plate member 163 in a radial direction, they can prevent the plate member 163 from being deformed although the plate member 163 is pushed by a large quantity of food waste stuck thereto.

Furthermore, the crush plate support 165 adjusts an amount of the food waste pushed toward the crush plate 162, so that it can prevent the crusher 160 or the agitating screw 120 from being damaged. Further, the crush plate support 165 can prevent the food waste jammed in the crusher 160 from becoming stuck, and thus avoid overloading the motor 130.

Figure 8:
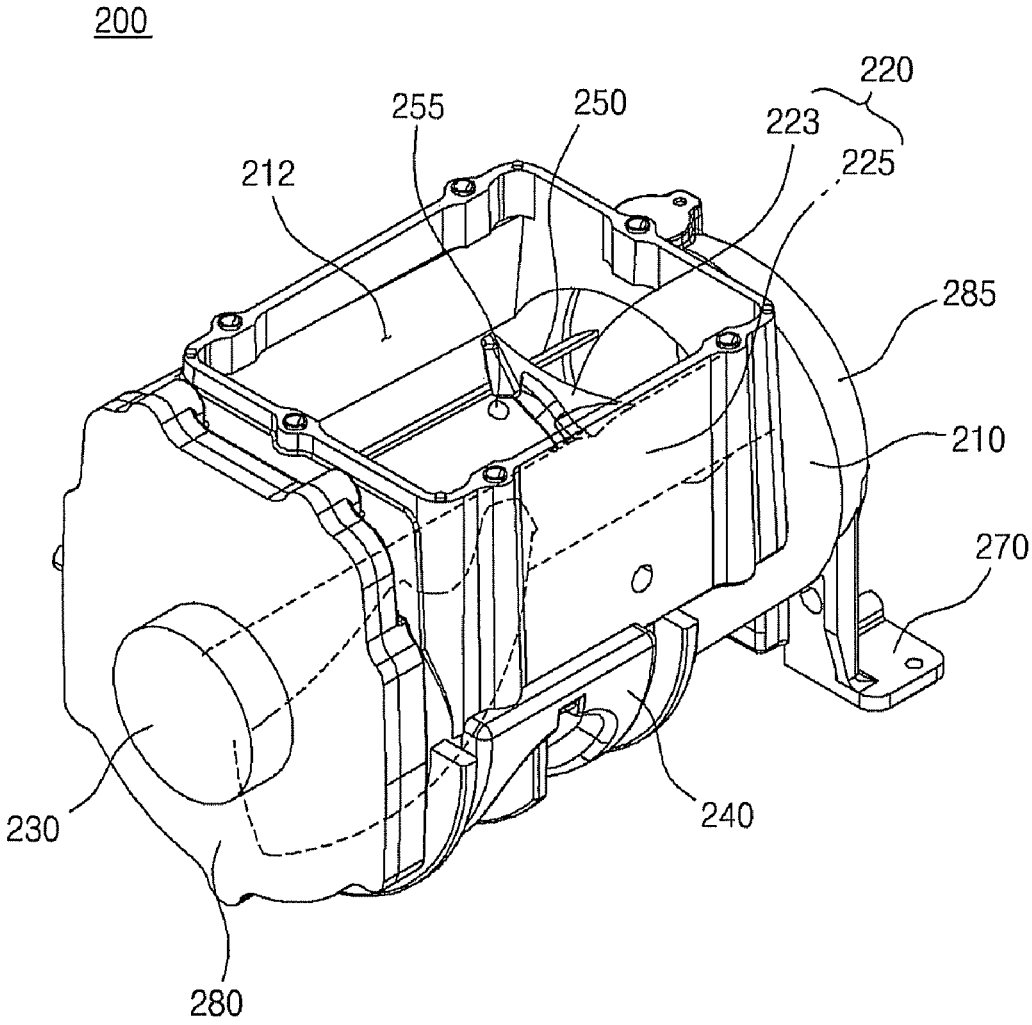
FIG. 8 is a right-side perspective view illustrating a drier for a food waste disposal system according to another embodiment of the present invention.
Figure 9:
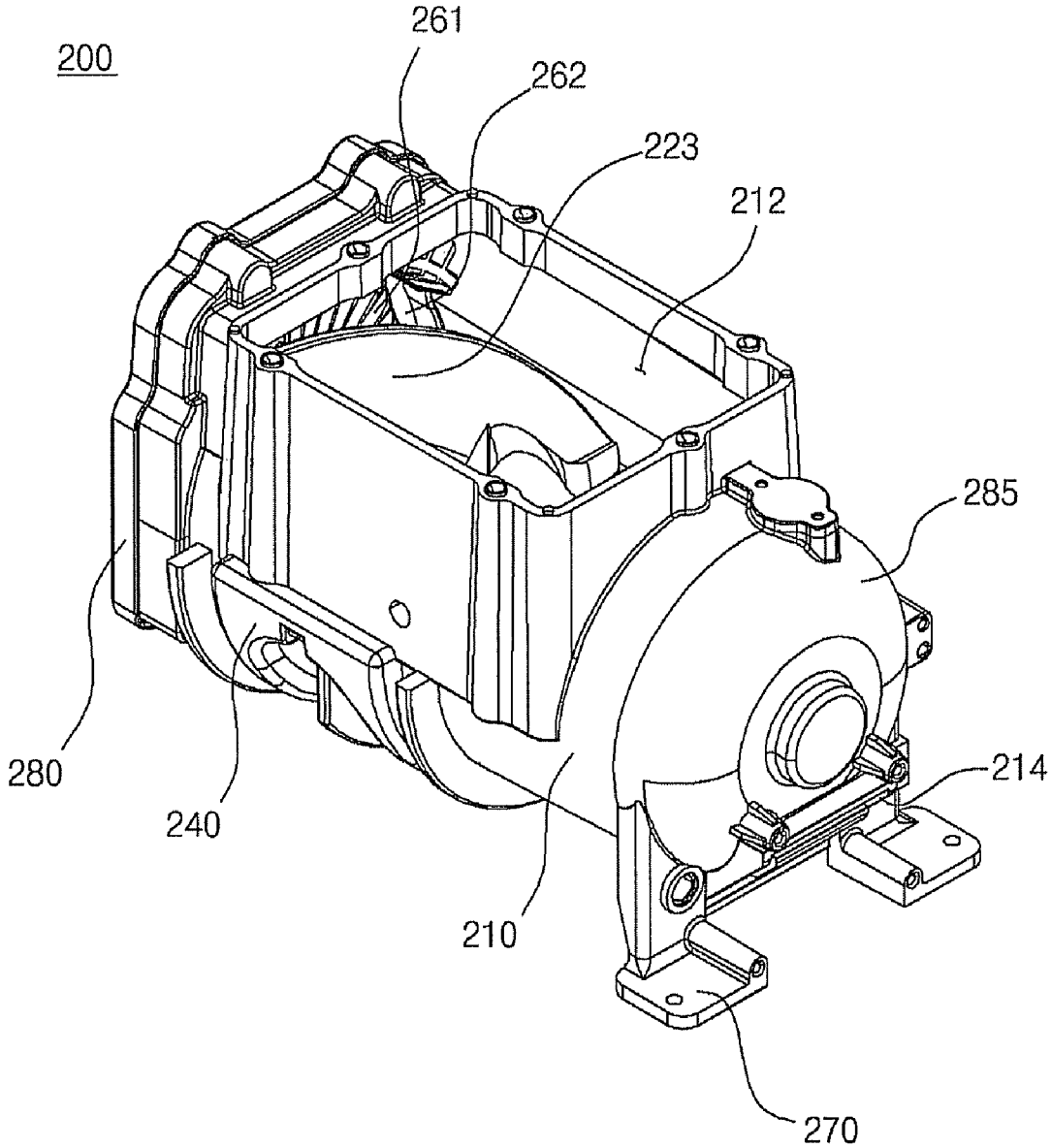
FIG. 9 is a left-side perspective view illustrating a drier for a food waste disposal system according to another embodiment of the present invention.
Figure 10:
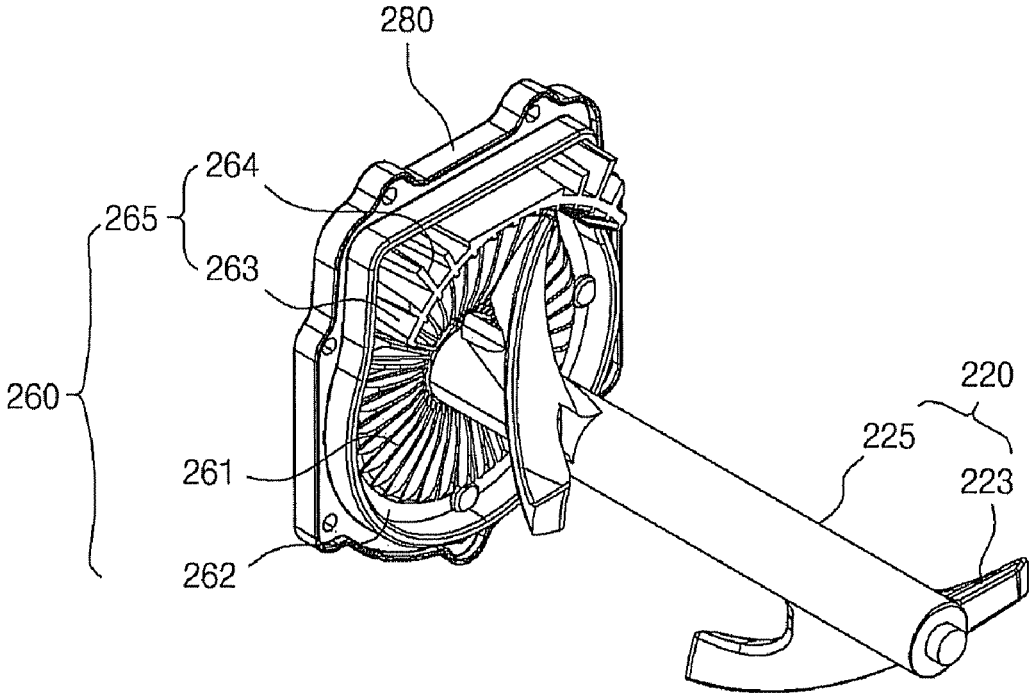
FIG. 10 is a perspective view illustrating an assembly of an agitating screw and a crusher installed in the drier for a food waste disposal system illustrated in FIG. 8.
Figure 11:
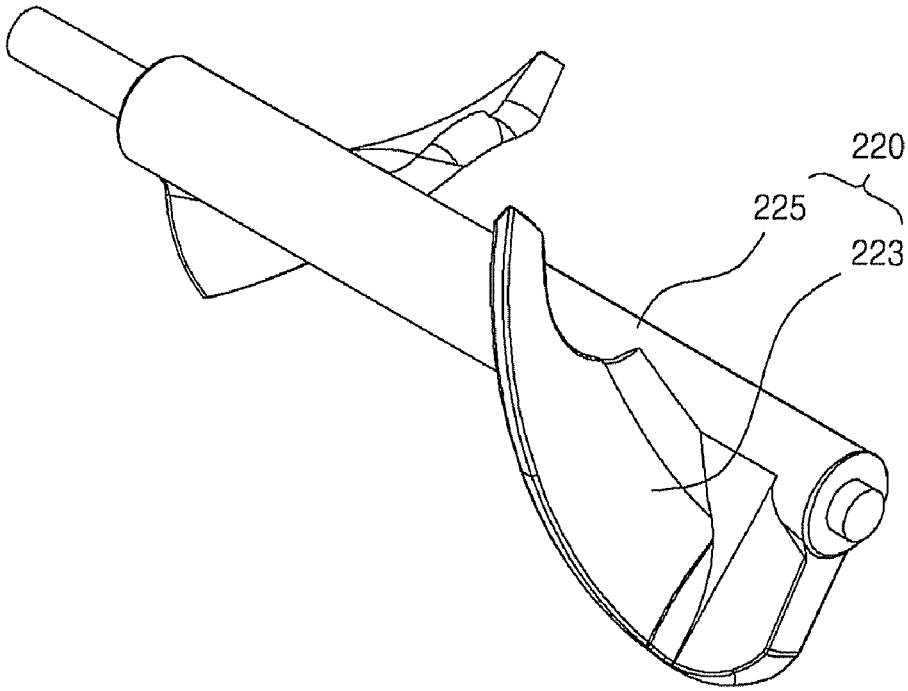
FIG. 11 is a perspective view illustrating the agitating screw of FIG. 10.

FIG. 8 is a right-side perspective view illustrating a drier for a food waste disposal system according to another embodiment of the present invention. FIG. 9 is a left-side perspective view illustrating a drier for a food waste disposal system according to another embodiment of the present invention. FIG. 10 is a perspective view illustrating an assembly of an agitating screw and a crusher installed in the drier for a food waste disposal system illustrated in FIG. 8. FIG. 11 is a perspective view illustrating the agitating screw of FIG. 10.

Referring to FIGS. 8 through 11, the drier 200 for a food waste disposal system according to another embodiment of the present invention includes: a hollow drum 210 having a charge port 212 into which dehydrated food waste is charged and a discharge port 214 through which dried food waste is discharged; an agitating screw 220 having a plurality of hook-shaped rotating threads 223 which is rotatably disposed in an inner space of the drum 210 and agitates and crushes the dehydrated food waste charged into the drum 210, and a rotating shaft 225 around which the rotating threads 223 are disposed; a motor 230 installed on a first end of the drum 210 and providing a rotating force to the agitating screw 220; a crusher 260 having a circular crush plate 262 that is installed on the second end of the drum 210 in which the motor 230 is coupled with the agitating screw 220 and that has a plurality of inclined crushing blades 261 arranged radially, and an arcuate crush plate support 265 which is installed around an upper portion of the crush plate 262; and a heater 240 installed on an outer surface of the drum 210 and which when powered provides high-temperature heat for the inner space of the drum 210 thereby drying the food waste. The portion overlapping with the embodiment described with reference to FIGS. 1 through 7 will not be described.

The agitating screw 220 is disposed in the inner space of the drum 210 so as to be rotatable in a forward or backward direction such that the food waste charged into the inner space through the charge port 212 of the drum 210 can be agitated and crushed.

The agitating screw 220 is a rotary member in which a plurality of or a single rotating thread 223 is mounted on the rod-like rotating shaft 225. One end of the rotating shaft 225 is coupled with the motor 230 installed on a front cap 280 at the first end of the drum 210, and the other end of the rotating shaft 225 is installed and supported in the shaft hole (not shown) of a rear cap 285 at the second end of the drum 210.

In this case, the inner surface of the drum 210 is spaced apart from the rotating thread 223 of the agitating screw 220 by a gap having a predetermined interval such that the rotating thread 223 is rotated without interference.

Each rotating thread 223 has the shape of a hook, an end of which is crooked, is rotatably disposed in the inner space of the drum 210, and agitates and crushes the food waste charged into the drum 210. The rotating threads 223 are mounted on the rotating shaft 225.

The rotating threads 223 are spaced apart from each other such that the crooked ends thereof are opposite each other. To this end, in the state where the rotating thread 223 disposed around the rotating shaft 225 extends without interruption, its intermediate portion is removed. The ends of the rotating threads 223 are formed into a hook shape.

An outer edge of each rotating thread 223 rotated adjacent to the inner surface of the drum 210 is sharply formed so as to be able to crush the food waste.

Each rotating thread 223 can be removably mounted on the rotating shaft 225. Thus, when any rotating thread 223 is broken or bent, the rotating thread 223 is replaced so that the agitating screw 220 can be used for a long time.

The agitating screw 220 having these rotating threads 223 can prevent accumulation of the food waste when the rotating threads 223 are rotated as well as preventing overloading the motor 230.

In detail, a part of the food waste escapes between the rotating threads 223, and thus does not accumulate. The food waste is pulled into the drum 210 by the crooked ends of the rotating threads 223, so that the possibility of overloading the motor 230 is lowered.

Although exemplary embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A drier for a food waste disposal system, comprising:

a hollow drum having a charge port into which dehydrated food waste is charged and a discharge port through which dried food waste is discharged;

an agitating screw having at least two hook-shaped rotating threads which are rotatably disposed in an inner space of the drum, which agitates and crushes the dehydrated food waste charged into the drum, and a rotating shaft around which the rotating threads are disposed;

a motor installed on a first end of the drum and providing a rotating force to the agitating screw; and a heater installed on an outer surface of the drum which when powered provides high-temperature heat for the inner space of the drum thereby drying the food waste, wherein the rotating threads are spaced apart from each other, and include crooked ends so as to face each other.

2. The drier as set forth in claim 1, wherein the rotating threads are removably mounted on the rotating shaft.

3. The drier as set forth in claim 1, further comprising a crusher having a circular crush plate that is installed on a second end of the drum in which the motor is coupled with the agitating screw and which has a plurality of inclined crushing blades arranged radially, and an arcuate crush plate support which is installed around an upper portion of the crush plate.

4. The drier as set forth in claim 3, wherein the crush plate support includes a circular plate member surrounding the crush plate, and rib members protruding from an outer surface of the plate member in a radial direction.

5. The drier as set forth in claim 1, wherein the drum includes a plurality of ridges on an inner surface thereof which extends in an axial direction.

6. The drier as set forth in claim 5, wherein the drum further includes a plurality of knobs on the inner surface thereof which protrudes at a predetermined height in an inward radial direction.

7. The drier as set forth in claim 5, wherein the ridges are symmetrically disposed on left and right sides centering on a bottom of the drum.

* * * * *